US006499688B1

(12) United States Patent
Bissell et al.

(10) Patent No.: US 6,499,688 B1
(45) Date of Patent: Dec. 31, 2002

(54) OPTICAL FIBER RIBBON WINDING APPARATUS AND METHOD

(75) Inventors: Steven T. Bissell, Hickory, NC (US); Michael DeCarlo, Hickory, NC (US); Toby Ray Smith, Granite Falls, NC (US)

(73) Assignee: CCS Holdings, Inc., Hickory, NC (US)

( * ) Notice: Subject to any disclaimer, the term of this patent is extended or adjusted under 35 U.S.C. 154(b) by 0 days.

(21) Appl. No.: 08/688,285

(22) Filed: Jul. 29, 1996

(51) Int. Cl.[7] ..... B65H 18/08
(52) U.S. Cl. ..... 242/471
(58) Field of Search ..... 242/471, 18.1, 242/158 R, 534, 563

(56) References Cited

U.S. PATENT DOCUMENTS

| | | | | | |
|---|---|---|---|---|---|
| 1,588,995 | A | | 6/1926 | Ruf | |
| 2,660,382 | A | | 11/1953 | Wilson | 242/158 |
| 3,448,253 | A | | 6/1969 | Bramblett, II et al. | 235/151.1 |
| 3,724,638 | A | * | 4/1973 | Peters et al. | 198/24 |
| 3,845,912 | A | | 11/1974 | Eichmanns et al. | 242/18 R |
| 3,951,355 | A | | 4/1976 | Morioka et al. | 242/158 R |
| 4,029,214 | A | * | 6/1977 | Benedict et al. | 198/431 X |
| 4,061,285 | A | | 12/1977 | Powers, Jr. | 242/18 R |
| 4,150,801 | A | | 4/1979 | Ikegami et al. | 242/158 R |
| 4,169,565 | A | | 10/1979 | Blok et al. | 242/18 R |
| 4,328,931 | A | * | 5/1982 | Gordon-Clark et al. | 242/534 |
| 4,386,863 | A | * | 6/1983 | Rooney | 400/185 |
| 4,394,986 | A | | 7/1983 | Hasegawa et al. | 242/18 R |
| 4,401,924 | A | | 8/1983 | Grover | 318/6 |
| 4,477,035 | A | * | 10/1984 | O'Connor | 242/471 |
| 4,489,901 | A | * | 12/1984 | Andersen | 242/471 |
| 4,535,955 | A | | 8/1985 | Custer | 242/158 R |
| 4,695,010 | A | | 9/1987 | Smith | 242/158 R |
| 4,884,764 | A | | 12/1989 | Hill | 242/158 R |
| 5,141,169 | A | | 8/1992 | Sugioka | 242/18 R |
| 5,318,167 | A | * | 6/1994 | Bronson et al. | 198/577 |
| 5,499,775 | A | | 3/1996 | Vander Groef | 242/158 B |

OTHER PUBLICATIONS

"S18 Series Fixed–field Sensors", P/N 2952513B, Banner Engineering Corp.
Heathway Product Information "FT/DW. Fibre Tractor / Drum Winder", 5/87.
Heathway "Multi–Optical Fibre Ribbon Cable System" brochure, 11/89.
Nokia–Maillefer "Optical fiber ribbon system OFC 21", 10/94.

* cited by examiner

*Primary Examiner*—John Q. Nguyen

(57) ABSTRACT

An automated winding apparatus includes a deflection sheave for directing a flat filament onto a rotating take-up reel. The deflection sheave sequentially moves progressively farther away from the take-up reel in response to information provided by a proximity sensor which detects the position of the outermost filament layer accumulating on the reel. The deflection sheave initially may be moved toward the take-up reel after a predetermined length of filament has been wound.

10 Claims, 4 Drawing Sheets

OPTICAL FIBER RIBBON WINDING APPARATUS AND METHOD

BACKGROUND OF THE INVENTION

This invention relates to automated machinery for winding flat filaments, in particular optical fiber ribbons, onto a take-up reel.

The prior art includes many devices for winding cables, filaments, or the like. Many automated winding devices include a mechanism for traversing the filament from side to side in a direction parallel to the axis of the take-up reel. In addition, some devices provide for an outward radial adjustment of a traverse guide arm to accommodate the increasing diameter of the windings already on the reel. The goal of many winding devices is to wind the filament onto the take-up reel in smooth layers without leaving bunches or gaps into which the filament may fall as the next outermost layer is wound. This invention principally concerns an improved device for the outward radial adjustment of a winding mechanism in which a guide means, such as a deflection sheave or guide arm, dispenses the filament onto the take-up apparatus.

In prior art winding devices, a guide arm typically is used to guide the rope, cable, wire, or yarn onto the drum of a take-up device, usually a reel. The guide arm is typically an elongated bar with a hole at its distal end. The filament to be wound is threaded through this hole. As the filament is wound, the guide arm moves, and the filament is directed to a desired position by the force exerted thereon by the guide arm. In the alternative, the traverse may be accomplished by keeping the traverse guide arm in a fixed position and traversing the take-up reel along its axis.

Some prior art winding devices act to press the filament into its desired position through the action of an elongate bar which presses on the filament as it contacts the drum or the previously wound filament package. An example of such a winding device is described in U.S. Pat. No. 3,951,355. This bar may be an extension of the guide arm or may be a separate structure.

Flat filaments are more difficult to wind than cylindrical filaments. Flat filaments bend more easily in some directions than in other directions, which may result in asymmetrical forces which cause the flat filament to behave unpredictably, particularly as the number of forces on the filament increase. Cross-sections of flat filaments have a non-uniform exterior profile, as compared to a cylindrical filament, making it more important to keep the flat filament from twisting onto its side while being wound.

Optical fiber ribbons are flat filaments which typically include a parallel array of coated optical fibers which are enclosed within at least one layer of polymer material having an external rectangular cross-section with rounded corners. Optical fibers can be damaged by external forces placed upon them. Excessive bending, rubbing or twisting of the optical fiber ribbons can lead to physical damage to the ribbons which can cause excess attenuation of the light passing through the optical fibers therein. Because of these concerns, optical ribbon winding devices have been operated at low speeds to avoid any damage to the optical fiber ribbons. Low production speeds in turn increase manufacturing costs of optical fiber ribbon cablers.

The ribbon outer common coating typically has a minimum coefficient of friction. For this reason, it is impractical to push a ribbon across the surface of another ribbon to adjust its position. Precise initial placement of the ribbon onto the take-up reel is of paramount importance in preventing physical damage to the ribbon and possible excessive increases in optical fiber attenuation.

SUMMARY OF THE INVENTION

It is therefore an object of the present invention to provide an optical fiber ribbon winding apparatus capable of operation at higher speeds than allowed by previous winding apparatus.

Another object of the invention is to provide an optical fiber ribbon winding apparatus which less frequently causes damage to the ribbon being wound, and may or may not utilize a guide arm to mechanically guide the optical fiber ribbon between the final deflection sheave and the take-up reel.

Still another object of the invention is to provide an optical fiber ribbon winding apparatus including an improved movement system to accommodate an accumulating filament package on the take-up reel.

Yet another object of the invention is to keep the optical fiber ribbon within an essentially vertical plane as it is being wound.

These and other objects are provided, according to the present invention, by a winding machine comprising a carriage bearing a guide means. The flat filament is directed by said guide means to be dispensed onto the take-up reel, where the filament is wound continuously in accumulating layers. The take-up reel is traversed back and forth parallel to its own axis in a manner well known to the art. The tension on the flat filament is monitored and controlled. A first proximity sensor mounted to the carriage senses the position of the outermost accumulating filament layer when it is within a predetermined distance. Information from the first proximity sensor is transmitted to a programmable logic controller.

It is necessary to prevent the guide means from impinging against the flanges of the take-up reel. The controller may be programmed to cause the ends of the filament layers to be spaced apart by a greater distance from the reel flanges after a predetermined number of filament layers have been wound. After the predetermined number of filament layers have been wound, the winding may assume a trapezoidal shape in cross-section. The programmable logic controller may cause the carriage to move the guide means forward, toward the take-up reel, when a predetermined length of filament has been dispensed, or, equivalently, when a predetermined number of layers of filament have been wound onto the take-up reel. Thus, the carriage is moved forward only when there exists sufficient spacing between the ends of the outermost filament layer and the respective flanges to provide clearance for the guide means.

After the carriage has been moved forward, the proximity sensor detects the presence of the accumulating outermost filament layer on the take-up reel, and the programmable logic controller activates the carriage as needed to maintain the guide means within a predetermined range of distance from the outermost filament layer. Thus, the carriage and guide means are moved sequentially to positions at a greater radial distance from the take-up reel longitudinal axis as the filament layers accumulate onto the take-up reel.

The invention allows the length of free ribbon between the guide means and the outermost layer of ribbon on the take-up reel to be minimized, thereby minimizing the amplitude of any vibration or other path perturbation which could compromise the quality of the winding.

BRIEF DESCRIPTION OF THE DRAWINGS

The preferred embodiments of the invention are described in the several drawings, in which.

DETAILED DESCRIPTION OF THE INVENTION

Figure 1:
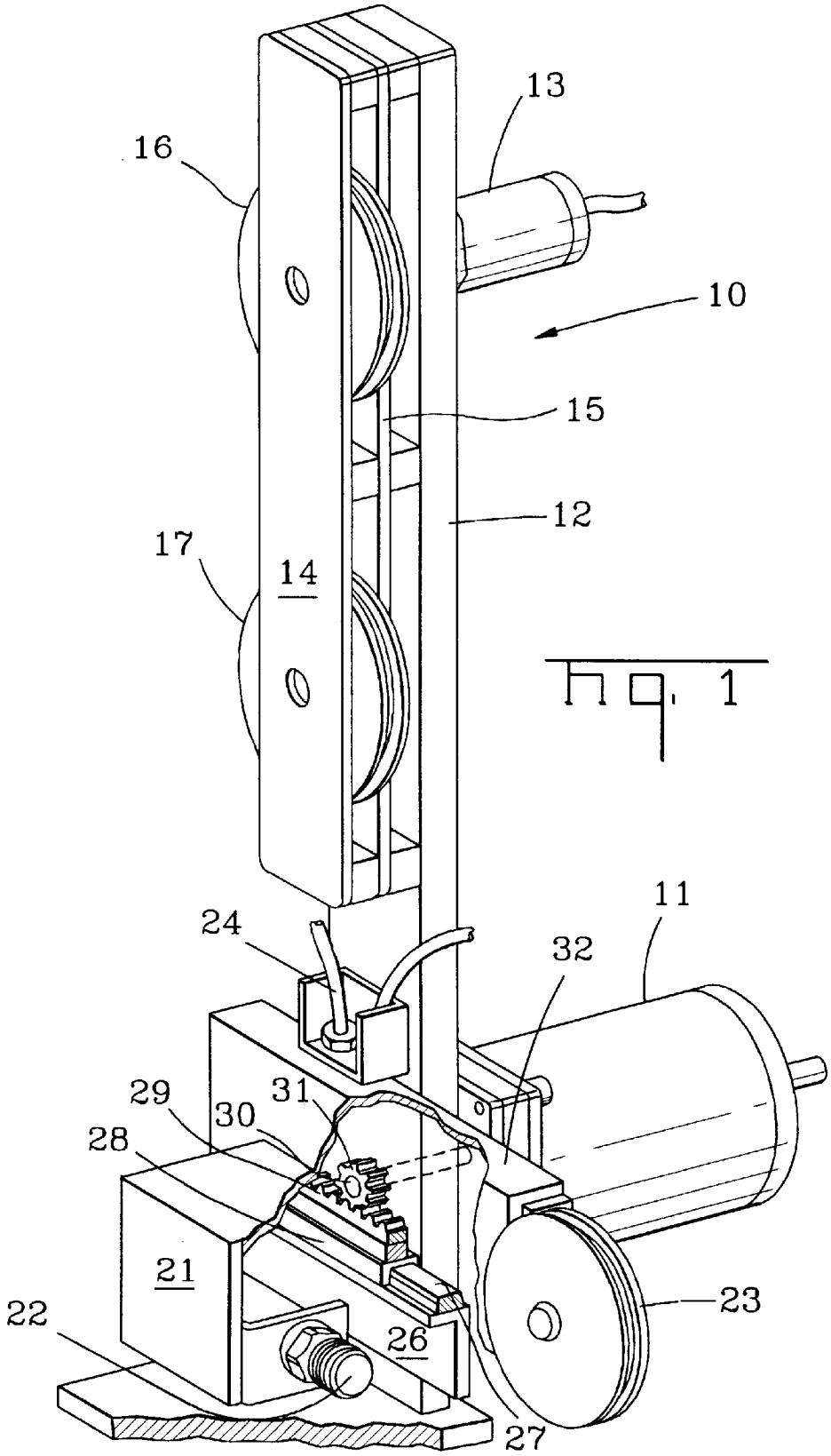
FIG. 1 is a perspective view of the winding apparatus.

The present invention will be described more fully hereinafter with reference to the accompanying drawings, in which one or more preferred embodiments of the invention are shown. This invention may, however, be embodied in many different forms and should not be construed as limited to the embodiments set forth herein; rather, these embodiments are provided so that the disclosure will fully convey the scope of the invention to those skilled in the art. Like numbers refer to like elements throughout. The drawings are not necessarily drawn to scale but are configured to clearly illustrate the invention.

As background, a basic description of prior art take-up functions is provided below.

A prior art winding device includes a reel motor, which rotates a take-up reel, and a traverse motor, which drives a traverse mechanism. In this instance, it is the reel which traverses to and fro along its own axis, although in some applications the winding apparatus may be caused to traverse instead. The distance that the traverse mechanism travels per rotation of the reel is called the traverse pitch. The traverse pitch is typically a variable parameter to accommodate filaments of different widths. Prior art fiber optic ribbon take-up systems including traverse capability include the Multi-optical Fibre Ribbon Cable System provided by Heathway, having offices in Horsham, Pa., and the OFC 21 optical fiber ribbon system provided by Nokia-Mallefer, having offices in Norcross, Ga.

The reel motor is a dc motor and is controlled by a designated dc drive. The drive receives a 0 to 10 volt line speed reference voltage from the main programmable logic controller to determine the speed of the reel motor. The main programmable logic controller may be a Mitsubishi Model A2A. The reference voltage is adjusted based on input from a dancer in order to maintain a predetermined tension on the filament. An encoder is mounted on the reel motor and is driven by the motor shaft. This encoder is a device that outputs a predetermined number of square wave digital pulses per revolution of the motor shaft. These encoder pulses are transmitted to a special purpose controller that is capable of receiving and measuring a pulse train. The special purpose controller may be a MicroSpeed Model 196, provided by Drive Control Systems.

The traverse motor is also a dc motor that is controlled by a designated dc drive. On the traverse motor is mounted a second encoder which transmits its output pulse train to the special purpose controller. The special purpose controller is preset with the desired traverse pitch. Using the encoder pulse train from the reel motor as the reference master, the special purpose controller calculates a desired rate for the second encoder output pulse train, determining the proper ratio of the two pulse rates. The special purpose controller transmits a 0 to 10 volt dc analog reference voltage to the traverse motor drive to determine its speed relative to the reel motor. The special purpose controller automatically adjusts this voltage output to maintain the proper ratio between the two encoders, thereby forcing the traverse motor to follow the reel motor to maintain the preset traverse pitch.

As the filament is deposited onto the take-up reel, the filament builds up in layers around the reel drum between the reel flanges. Each edge of each filament layer is herein called a turnaround point. The positions of the turnaround points are selected to maintain predetermined distances between the turnaround points and the flanges, thereby avoiding damage to the filament or the winding apparatus. The turnaround points may be selected such that the width of the filament layers is not constant; for example, the layers may decrease in width with increasing radial distance from the take-up reel longitudinal axis. The turnaround points are determined by the main controller. The encoder pulses from the traverse motor are transmitted to a high speed digital up/down counter module in the main controller. The main controller counts up when the take-up reel traverses in a first direction and counts down when the take-up reel traverses in the opposite direction. When the number in a counter matches the preset number for a turnaround point, a digital output is triggered, energizing or deenergizing a relay which reverses the polarity of the reference voltage transmitted to the traverse motor. This polarity reversal causes the traverse motor to change directions.

Therefore, the system determining the turnaround points is independent of the system that maintains the traverse pitch at its preset distance.

The improved winding apparatus according to the invention does not affect any of the normal functions of the prior art light waveguide ribbon take-up assembly above described. However, several of those functions are monitored to provide information upon which the main programmable logic controller causes the final deflection sheave to be moved forward toward the take-up reel or retracted. The additional functions of the improved winding device are described below.

Figure 2:
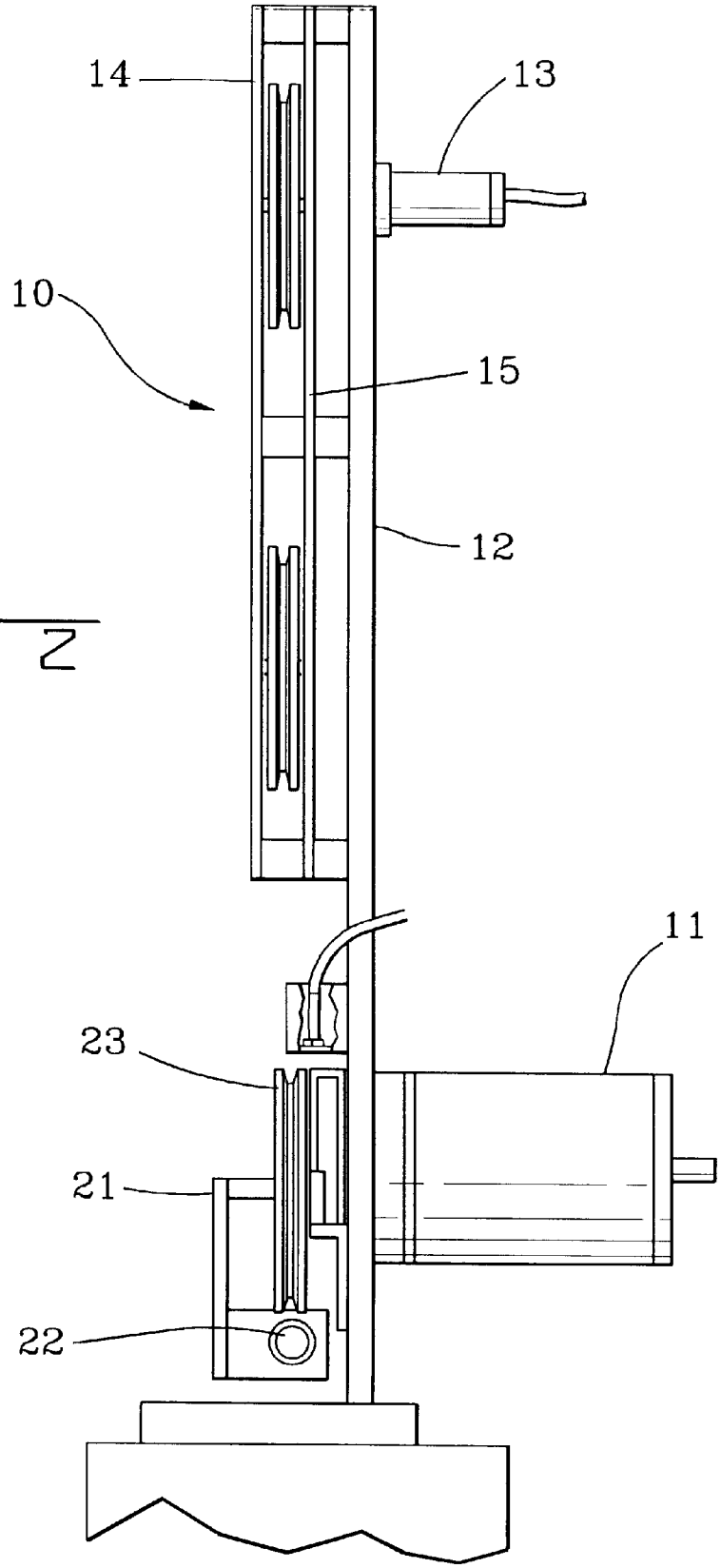
FIG. 2 is a front elevation of the winding apparatus.
Figure 3:
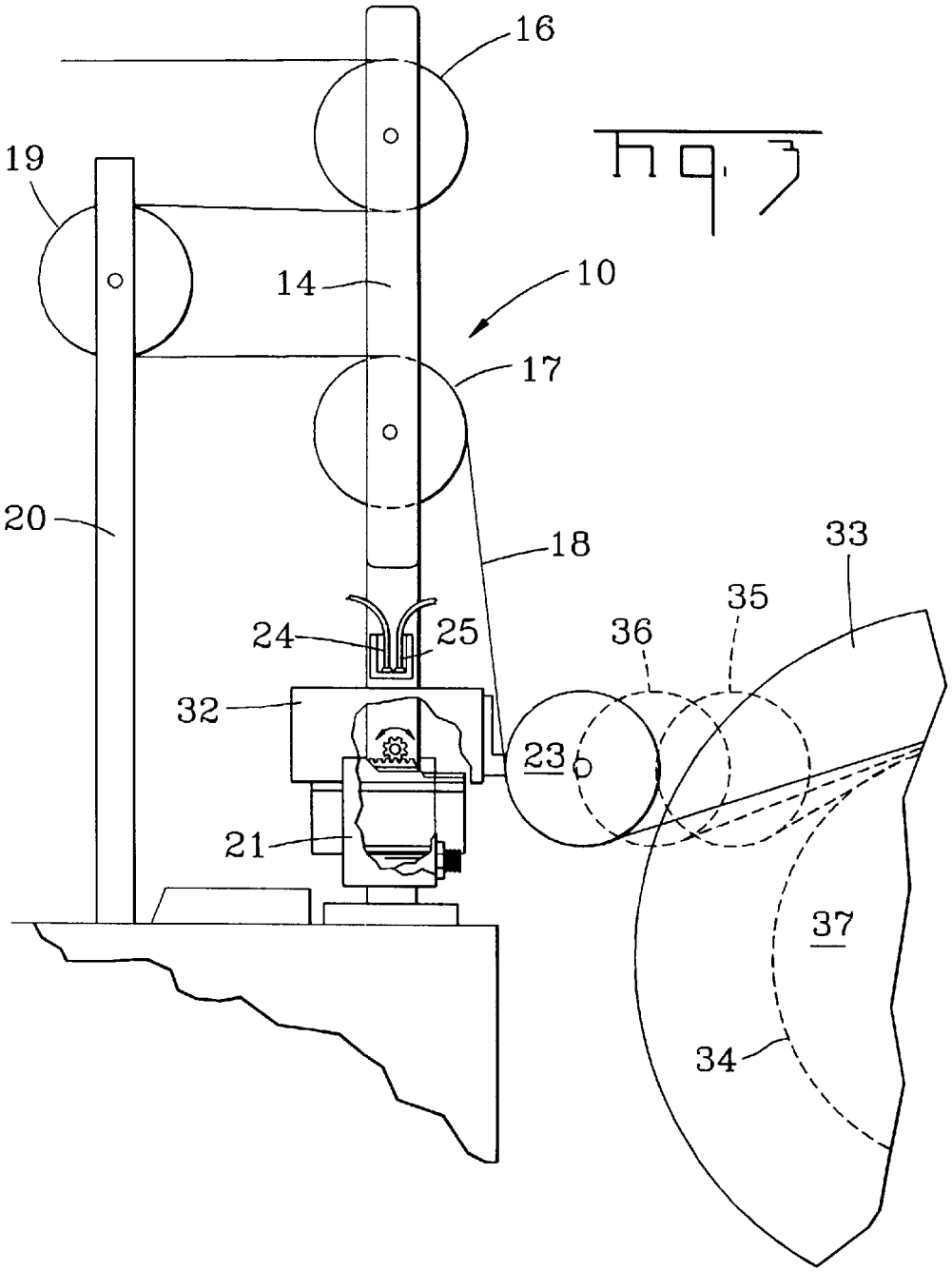
FIG. 3 is a side elevation of the winding apparatus as operated.

A winding apparatus 10, shown in FIGS. 1–3, includes a vertical main post 12 to which a first vertical sheave mounting post 14 and second vertical sheave mounting post 15 are secured in spaced-apart horizontal relation. Between posts 14 and 15 are mounted two rotatable deflection sheaves 16, 17. Upper deflection sheave 16 is mounted above lower deflection sheave 17.

As depicted in FIG. 3, an optical fiber ribbon 18 is received from the left. Winding apparatus 10 may be used at the end of a manufacturing line which forms the common coating, sometimes called the matrix coating, over a plurality of coated, colored optical fibers to form a flat filament having a rectangular cross-section with rounded corners. The common coating may be formed of material cured by ultraviolet light radiation, and in that case the manufacturing line includes a plurality of ultraviolet light curing lamps. Although winding apparatus 10 is primarily designed to operate in the initial take-up of the newly formed optical fiber ribbon, it 10 may also be used in other processes, such as respooling operations.

Optical fiber ribbon 18 first passes to the right along a first path as shown in the topmost portion of FIG. 3 and thence through about a half turn around rotatable upper deflection sheave 16, thence proceeding to the left along a second path which is spaced apart from and parallel to the first path at a lower height. The distance between the first and second paths is a function of the diameter of upper deflection sheave 16.

Optical fiber ribbon 18 thence passes through about a half turn around rotatable dancer sheave 19, thence proceeding to the right along a third path which is spaced apart from and parallel to the second path at a lower height. The distance between the second and third paths is a function of the diameter of dancer sheave 19.

Dancer sheave 19 is mounted for rotation on vertical arm 20, which is pivoted at its base and moved by an air cylinder. The pressure in the air cylinder is preset by the operator with an air pressure valve. Tension on sheave 16 is monitored by a tension monitoring device 13, which may be model no. 150 provided by Honigmann GmbH. As the load on upper deflection sheave 16 is supplied solely by optical fiber ribbon 18, the tension on optical fiber ribbon 18 is thereby determined indirectly. Monitoring device 13 transmits tension information to the line control system to be displayed on a monitoring screen.

To the extent that arm 20 is deflected from the vertical, the portions of optical fiber ribbon 18 traveling along the second and third paths as described above thereby will deviate slightly from the horizontal. As it leaves dancer sheave 19, optical fiber ribbon 18 travels along the third path to the right in FIG. 3 and thence makes an approximately one-quarter turn or less around lower deflection sheave 17 and proceeds downward to final deflection sheave 23. Optical fiber ribbon 18 then makes a partial turn around and under final deflection sheave 23 and is thence deposited directly onto take-up reel 37, which is driven to rotate and traverse as above described. The degree of turn under final deflection sheave 23 is determined by its position, as is the degree of turn around lower deflection sheave 17.

Slide base 27 forms the upper surface of support 26, which is mounted to main post 12. Also mounted to main post 12 is motor 11, which has a drive shaft 30 which serves as the axis of pinion gear 31.

Deflection sheave 23 is mounted for rotation to structure 32, which includes a slide 28 as its lower surface. Slide 28 is movably carried on the upper surface of slide base 27. Mounted over slide 28 is rack gear 29, which is moved forward or retracted by the action of pinion gear 31. Also mounted to structure 32 is mount 21, which holds proximity sensor 22.

Thus, as stepper motor 11 turns pinion gear 31, rack gear 29 moves both deflection sheave 23 and proximity sensor 22. Proximity sensor 22 is vertically aligned below deflection sheave 23, as seen in FIG. 2. Proximity sensor 22 may be a Banner fixed field sensor model S18SP6FF100Q utilizing a MQDC-415RA cable. Structure 32 is omitted in FIG. 2 for clarity.

Figure 4:
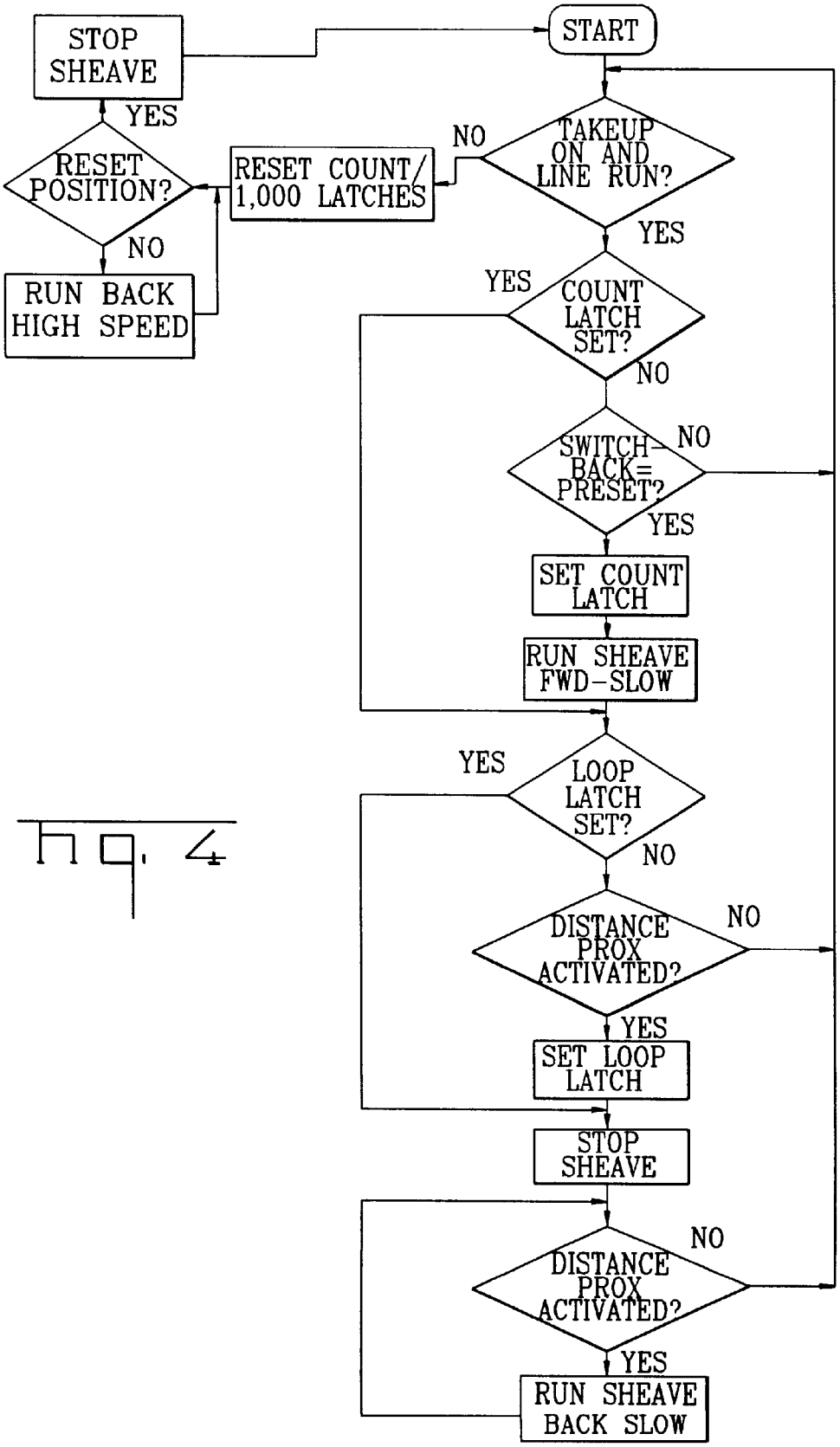
FIG. 4 is a flow chart of processing logic utilized by the controller.

The operation of the winding apparatus will now be described, with reference to FIGS. 3 and 4. FIG. 4 details the logic flowchart of the programmable logic controller control apparatus controlling drive motor 11. This control apparatus used in the preferred embodiment described below is the main programmable logic controller; however, other control apparatus may be used as dictated by the particular manufacturing environment.

At start, the pinion gear moves structure 32 back to its extreme position which is most distant from take-up reel 37, called the reset position, if either the take-up is not turned on or the processing line is not running. The reset position is detected through front proximity sensor 25, which is vertically mounted to main post 12 and views downward to the upper surface of structure 32. As structure 32 reaches its reset position, a hole in the upper surface of structure 32 moves beneath front proximity sensor 25. If front proximity sensor 25 fails to detect the upper surface of structure 32, the reset position has been reached. Motor 11 is then stopped, completing the first loop.

If either the take-up is not on or the processing line is not running, the loop and count latches are reset. The functions of these latches are set out below.

If the take-up is on and the processing line is running, the controller waits until the number of turnaround points (switchbacks) equals a preset number. During this time, the main programmable logic controller causes the widths of the layers to be narrowed from an initial greater width on the drum to an indented configuration in which the turnaround points are further spaced apart from flanges 33. Until the preset number is reached, the rack remains in its reset position to avoid damage to the winding apparatus or the optical fiber ribbon by contact with flanges 33. When the preset number is reached, the count latch is set and the final deflection sheave 23 is slowly moved forward toward take-up reel 37, completing the second loop.

Deflection sheave 23 continues slowly moving forward toward take-up reel 37 until proximity sensor 22 is activated. Proximity sensor 22 is activated when the distance between proximity sensor and outermost winding layer 34 decreases to a predetermined distance. When this occurs, the loop latch is set and the final deflection sheave 23 stops moving forward, completing the third loop.

As a precaution, a back proximity sensor 24 detects whether the rack has reached an extreme forward position. If the extreme forward position is reached, no further forward movement is allowed. Back proximity sensor operates in the same manner as front proximity sensor 25 above described, with a second hole being placed in the upper surface of structure 32. Sensors 24, 25 each may be a Omron model no. E2E-X1C1.

In the fourth loop, the stepper motor 11 slowly moves the rack gear 29 backward, moving final deflection sheave 23 backward until proximity sensor 22 is no longer activated. This process continues in the manner indicated in FIG. 3, with hatched line 35 indicating a forward position, and hatched line 36 indicating a rearward position of deflection sheave 23. Hatched line positions of structure 32 and mount 21 were not indicated to avoid undue prolixity of the drawing. The fourth loop continues until the winding is complete; the take-up and processing line then are stopped, stopping the process as shown at the beginning of the flow chart.

Thus, the newly made optical fiber ribbon is subjected to minimum stress during the winding process. By controlling the distance between the final deflection sheave and the take-up reel, a guide arm mechanically guiding the optical fiber ribbon in the interval between the final deflection sheave and the take-up reel may be omitted . The path followed by the optical fiber ribbon is kept in an essentially vertical plane until it is incorporated into the structure of the winding.

Good results are achieved by maintaining a distance of no more than about one inch between the final deflection sheave and the outermost layer of the winding. The distance varies within a small predetermined range which is much less than one inch. Line speeds of 300 m/min have been achieved with regularity.

Stepper motor 11 and its drive may be a Compumotor & Digiplan model PDS13-57-102, size 23.

The rack gear may be retained in the reset position if the inventive system described herein is not being used.

The guide means may be a deflection sheave, guide arm, or other apparatus which mechanically guides the optical fiber ribbon onto the take-up reel.

It is to be understood that the invention is not limited to the exact details of the construction, operation, materials, or embodiments shown and described, as modifications and equivalents will be apparent to one skilled in the art without departing from the scope of the invention.

What is claimed is:

1. An apparatus for winding an optical fiber ribbon on a reel, said apparatus comprising:

(a) a frame;

(b) an optical fiber ribbon guide movably mounted to said frame;

(c) an electrical control member, said electrical control member being operative to move said ribbon guide relative to said frame;

(d) an electronic sensor, said electronic sensor being operative to sense said optical fiber ribbon; and (e) an electronic controller, said electronic controller being electrically operatively associated with said electrical control member for controlling the position of said ribbon guide, and said electronic controller being electrically operatively associated with said electronic sensor whereby said electronic controller receives information from said electronic sensor;

(f) whereby, when said electronic sensor senses said optical fiber ribbon, said electronic controller is operative to control the position of said optical fiber ribbon guide.

2. The apparatus of claim 1, wherein said optical fiber guide and said electronic sensor are mounted to a common carriage.

3. The apparatus of claim 1, wherein said electrical control member is operatively connected to said common carriage.

4. The apparatus of claim 1, wherein said apparatus comprises a reset position sensor.

5. The apparatus of claim 1, wherein said apparatus comprises an over-travel sensor, said over-travel sensor being electrically operatively associated with said electronic controller.

6. The apparatus of claim 1, wherein said electrical control member comprises an electrical motor.

7. An apparatus for winding an optical fiber ribbon on a reel, said apparatus comprising:

(a) a movably mounted ribbon guide;

(b) an electrical control member, said electrical control member being operative to move said ribbon guide; and (c) an electronic sensor, said electronic sensor being operative to sense reflected electromagnetic energy impinging about said optical fiber ribbon; and (d) an electronic controller, said electronic controller being electrically operatively associated with said electrical control member for controlling the position of said ribbon guide, and said electronic controller being electrically operatively associated with said electronic sensor whereby said electronic controller receives information from said electronic sensor;

(e) whereby, when said electronic sensor senses electromagnetic energy impinging on said optical fiber ribbon, said electronic controller is operative to control the position of said optical fiber ribbon guide.

8. The apparatus of claim 7, wherein said apparatus comprises a reset position sensor, said reset position sensor being electrically operatively associated with said electronic controller.

9. The apparatus of claim 7, wherein said apparatus comprises an over-travel sensor, said over-travel sensor being electrically operatively associated with said electronic controller.

10. In a method of winding an optical fiber ribbon on a reel, comprising the steps of:

(a) providing an optical fiber ribbon wound on a reel and a movably mounted optical fiber ribbon guide;

(b) the optical fiber ribbon guide guiding the optical fiber ribbon towards said reel;

(c) providing an electronic system with an electrical control member, a programmed electronic controller, and an electronic sensor;

(d) the electronic controller controlling the electrical control member, the electrical control member operative to move said ribbon guide;

(e) the electronic sensor emitting electromagnetic energy toward the optical fiber ribbon, and sensing electromagnetic energy impinging on the optical fiber ribbon;

(f) the electronic controller receiving information from the electronic sensor sensing the optical fiber ribbon, and the electronic controller responding to the information by controlling the position of the optical fiber ribbon guide.

* * * * *